US006603441B2

(12) United States Patent
Teshima

(10) Patent No.: US 6,603,441 B2
(45) Date of Patent: Aug. 5, 2003

(54) COMPACT ANTENNA NOT EASILY BROKEN BY EXTERNAL FORCE, STABLE IN COMMUNICATION PERFORMANCE AND EXCELLING IN DURABILITY

(75) Inventor: Kentaro Teshima, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/085,939

(22) Filed: Feb. 28, 2002

(65) Prior Publication Data

US 2002/0122011 A1 Sep. 5, 2002

(30) Foreign Application Priority Data

Mar. 2, 2001 (JP) ..... 2001-058504

(51) Int. Cl.[7] ..... H01Q 1/36
(52) U.S. Cl. ..... 343/895; 343/711; 343/718
(58) Field of Search ..... 343/711, 712, 343/713, 718, 787, 788, 895

(56) References Cited

U.S. PATENT DOCUMENTS

| | | | | |
|---|---|---|---|---|
| 3,629,761 A | * | 12/1971 | Lundgren et al. | 336/192 |
| 5,220,339 A | * | 6/1993 | Matsushita | 343/788 |
| 5,867,100 A | * | 2/1999 | D'Hont | 340/572.1 |
| 5,933,117 A | | 8/1999 | Gerhard | 343/709 |

* cited by examiner

*Primary Examiner*—Don Wong
*Assistant Examiner*—Shih-Chao Chen
(74) *Attorney, Agent, or Firm*—Brinks Hofer Gilson & Lione

(57) ABSTRACT

A compact antenna is configured of a plurality of planar unit cores, belt-shaped linking members permitting bending or elastic deformation arranged on one side of the plurality of unit cores and linking the unit cores, a coil wound around a linked assembly consisting of the plurality of unit cores and the linking members, and a covering for covering around the linked assembly and the coil. A manufacturing method comprises a step of winding the coil, a step of linking the plurality of unit cores by the linking members, and a step of inserting the plurality of unit cores linked by the linking members into a hollow in the wound coil.

4 Claims, 2 Drawing Sheets

COMPACT ANTENNA NOT EASILY BROKEN BY EXTERNAL FORCE, STABLE IN COMMUNICATION PERFORMANCE AND EXCELLING IN DURABILITY

BACKGROUND OF THE INVENTION

1. Field of the Invention

The present invention relates to a compact antenna for use on vehicles and the like, and a manufacturing method therefor.

2. Description of the Related Art

Keyless entry systems are already available for use on vehicles enabling their user to remotely lock or unlock the doors of a vehicle with a signal transmitted from a wireless apparatus carried by the user. In such a keyless entry system, a door handle of the vehicle is provided with a compact antenna electromagnetically coupled to an antenna provided on the wireless apparatus carried by the user to transmit and receive necessary signals. As this compact antenna, one comprising a rod-shaped ferrite core around which a coil is wound is commonly used because of its low cost.

However, since ferrite is a brittle material, a compact antenna made of ferrite, when used in a keyless entry system, is likely to be easily cracked or chipped by the bending stress it is subjected to every time the door handle is operated, with the result that the communication performance of the compact antenna is susceptible to deterioration. This is particularly true of compact antennas using a rod-shaped ferrite core, which is subjected to heavy bending when exposed to external force.

It is proposed to add elasticity to antennas for more common use on vehicles for receiving radio waves or the like by inserting a plurality of unit cores into a hollow in the coil. However, in this kind of antenna for use on vehicles, each unit core is held only by the elasticity of the coil and moves independent of the coil, and the set spacing between the unit cores varies with the deformation of the coil, with the consequence that the communication performance of the coil is unstable and, moreover, any major external force is likely to subject the coil to plastic deformation, which means inadequate durability.

This kind of antenna for use on vehicles is manufactured by successively inserting a plurality of unit cores into the hollow in a coil, which is wound tightly and closed at one otherwise open end, from the other open end, thereby extending the tightly wound coil into a sparsely wound state, and engaging that other open end of the coil with the last inserted unit core. Since the plurality of unit coils formed independent of the coil are successively inserted into the hollow in the coil, the insertion of the unit cores into the coil takes a long time, tending to push up the cost of the antenna.

SUMMARY OF THE INVENTION

An object of the present invention, attempted to eliminate these shortcomings of the prior art, is to provide a compact antenna not easily broken by external force, stable in communication performance and excelling in durability, and a method for manufacturing such a compact antenna at low cost.

In order to solve the problems noted above, according to the invention, there is provided a compact antenna comprising a plurality of unit cores, linking members for linking external faces of the unit cores, and a coil wound around the plurality of unit cores, wherein the linking members are bendably arranged between the unit cores.

This configuration of linking external faces of the plurality of unit cores by linking members and arranging the linking members to be bendable between the unit cores serves to protect the unit cores from destruction and ensures stable communication performance for a long period because any external force would bend the linking members and prevent any major stress from arising in the unit cores. Also, as the unit cores are linked by the linking members, even if any external force deforms the compact antenna, the set spacing between the unit cores will remain unchanged to enable stable communication performance to be maintained. Moreover, as the unit cores are linked by the linking members, the deformation of the coil is regulated by the linked assembly of the unit cores, and deterioration in communication performance due to coil deformation can also be prevented. Furthermore, the arrangement of the linking members on the external faces of the plurality of unit cores enables the compact antenna to be formed in a planar shape, making it possible to provide a thin compact antenna.

The compact antenna may also have an arrangement in which the linking members in the above-described configuration are formed of elastic bodies.

The formation of the linking members of elastic bodies eliminates the need to form elastically deformable portions in the linking members, which are indispensable for rigid linking members, and the configuration of the linking members can be simplified with corresponding saving in the manufacturing cost of the compact antenna.

At the same time, regarding a compact antenna manufacturing method, the present invention provides a configuration comprising a step of winding a coil, a step of linking a plurality of unit cores by linking members, and a step of inserting into a hollow in the coil the plurality of unit cores linked by the linking members.

Thus, as the insertion of the plurality of unit cores linked by the linking members into a hollow in the coil makes it possible to insert a plurality of unit cores into a coil in a single process, the time required for inserting unit cores into the coil can be made shorter than inserting a plurality of unit cores one by one into a coil, resulting in corresponding saving in the compact antenna manufacturing cost.

A compact antenna manufacturing method according to another aspect of the invention comprises a step of linking a plurality of unit cores by linking members and a step of winding a coil around a linked assembly of the linking members and the plurality of unit cores linked to them.

The winding of the coil around the linked assembly of the linking members and the plurality of unit cores linked to them after linking the plurality of unit cores by the linking members as described above can make the integration of the coil with the linked assembly easier than inserting the unit cores and the linking members into the hollow in the wound coil, resulting in corresponding saving in the compact antenna manufacturing cost.

DETAILED DESCRIPTION OF THE PREFERRED EMBODIMENTS

Example 1 of Compact Antenna

Figure 1:
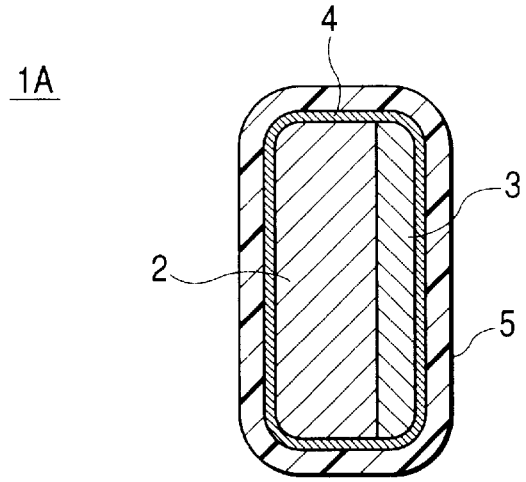
FIG. 1 shows a section of a compact antenna, which is a first preferred embodiment of the present invention.
Figure 2:
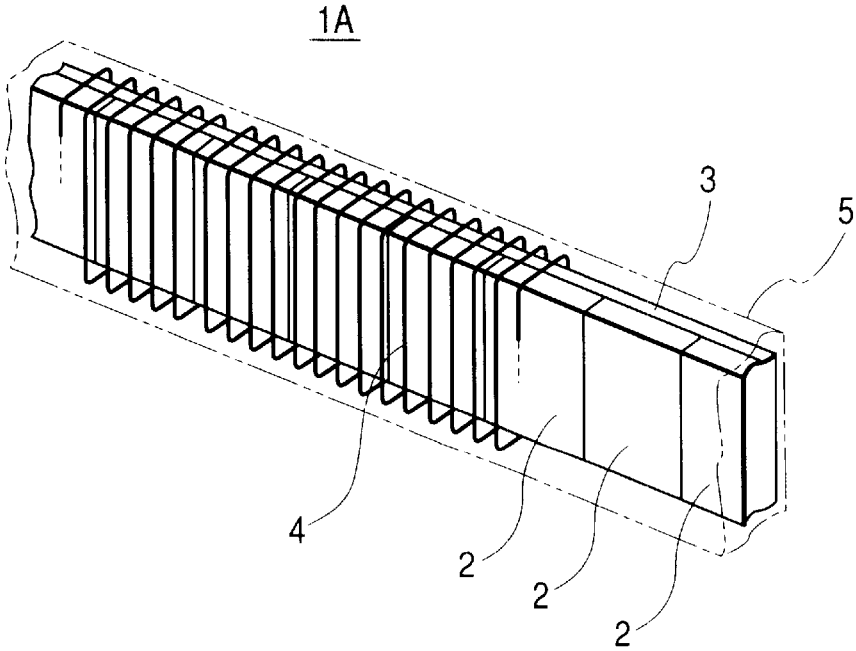
FIG. 2 shows a perspective view of the compact antenna, which is the first preferred embodiment of the invention, with its covering removed.

A first example of compact antenna embodying the present invention will be described below with reference to FIG. 1 through FIG. 3. FIG. 1 shows a section of a compact antenna, which is a first preferred embodiment of the invention; FIG. 2, a perspective view of the compact antenna, which is the first embodiment of the invention, with its covering removed; and FIG. 3, a perspective view of the compact antenna, which is the first embodiment of the invention, with its covering removed and under the load of external force.

As is evident from FIG. 1 and FIG. 2, a compact antenna 1A, which is this example, is configured of a plurality of planarly formed unit cores 2, belt-shaped linking members 3 arranged on one side of this plurality of unit cores 2 and linking the unit cores 2, a coil 4 wound around a linked assembly consisting of the plurality of unit cores 2 and the linking members 3, and a covering 5 for covering the surrounding of the linked assembly and the coil 4.

The unit cores 2 are formed of a magnetic material of high magnetic permeability and high saturation magnetic flux density, such as ferrite.

The linking members 3 are formed of an elastic material, such as a rubber plate or a metallic sheet, or structures whose essential parts are made readily deformable. The linking members 3 are arranged on one face of the unit cores 2, and link the unit cores 2 by adhesion or bolting. Where the linking members 3 are formed of rubber plates, the unit cores 2 can be linked by forming spiculate projections in advance on one face of the unit cores 2 and sticking the projections into the rubber-plate linking members 3. The unit cores 2 can be arranged either with one side of each unit in contact with the adjoining one as illustrated in FIG. 2 or with required gaps between them. Where the linking members 3 are formed of metal, it is particularly preferable to use a magnetic metal for superior communication performance.

The coil 4 is formed by winding either a bare lead wire or a covered lead wire. Where a bare lead wire is used, the coil 4 is formed by spaced winding, while a covered lead wire permits choice between tight winding and spaced winding.

The covering 5 is formed of an insulating and flexible resin material, such as vinyl chloride, or a rubber material. Where the coil 4 is formed of a covered lead wire, this covering 5 can be dispensed with.

Figure 3:
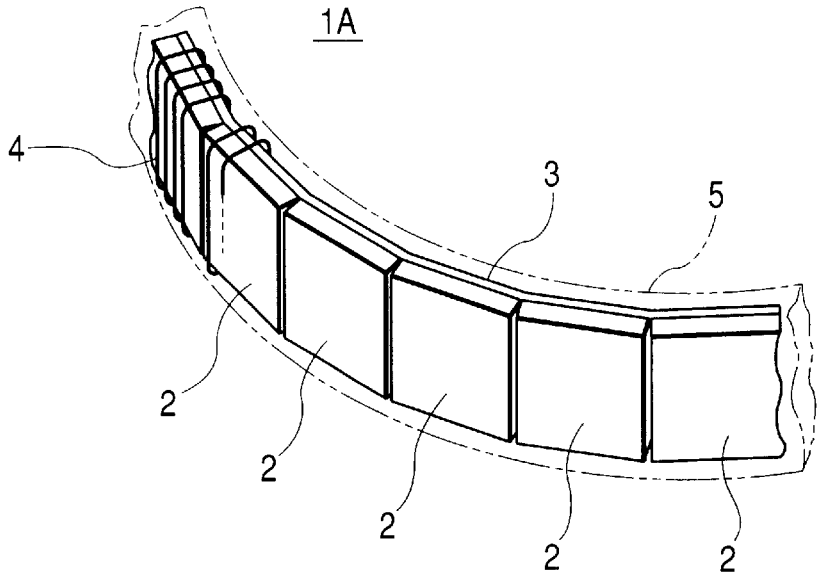
FIG. 3 shows a perspective view of the compact antenna, which is the first preferred embodiment of the invention, with its covering removed and under the load of external force.

Since the compact antenna 1A embodying the invention in this way, when subjected to external force, is elastically bent in the direction of the thickness of the linking members 3 as shown in FIG. 3, no heavy stress arises in any of the unit cores 2, which therefore can be protected from destruction, and stable communication performance can be maintained for a long period. Moreover, as the unit cores 2 are linked by the linking members 3, even if the compact antenna 1A is deformed by external force, the set spacing between the unit cores 2 will hardly vary, again making it possible to maintain stable communication performance. Furthermore, since the unit cores 2 are linked by the linking members 3, any deformation of the coil 4 would be regulated by the linked assembly of the unit cores 2, and communication performance can be prevented from deterioration by any deformation of the coil 4. Where the linking members 3 are formed of elastic bodies, such as rubber plates or metallic sheets, there is no need to form readily deformable portions in the linking members 3, and accordingly the configuration of the linking members 3 can be simplified with corresponding saving in the manufacturing cost of the compact antenna 1A. Also, as the linking members 3 are arranged outside the plurality of unit cores 2 in the compact antenna 1A of this embodiment of the invention, the compact antenna 1A can be formed in a planar shape, making it possible to provide a thin compact antenna.

The compact antenna 1A described above, which is the first preferred embodiment of the present invention, can be manufactured by a first method comprising a step of winding the coil 4, a step of linking the plurality of unit cores 2 by the linking members 3, and a step of inserting the plurality of unit cores 2 linked by the linking members 3 into the hollow in the wound coil 4, as well as by a second method comprising a step of linking the plurality of the cores 2 by the linking members 3 and a step of winding a coil around the linked assembly consisting of the linking members 3 and the plurality of unit cores 2 linked thereto.

By the first manufacturing method described above, as the plurality of unit cores 2 linked by the linking members 3 are inserted into the hollow in the coil 4, the insertion of the plurality of unit cores 2 into the hollow in the coil 4 can be accomplished in a single process, and accordingly the time required for inserting the unit cores 2 into the coil can be made shorter than the prior art of inserting a plurality of unit cores one by one into a coil, resulting in corresponding saving in the manufacturing cost of the compact antenna 1A. Or by the second manufacturing method, as the coil 4 is wound around the linked assembly consisting of the linking members 3 and the plurality of the unit cores 2 linked thereto after the plurality of the unit cores 2 are linked by the linking members 3, the integration of the coil 4 with the linked assembly is made easier than inserting the unit cores 2 and the linking members 3 into the hollow in the wound coil 4, resulting in corresponding saving in the manufacturing cost of the compact antenna 1A.

Example 2 of Compact Antenna

Figure 4:
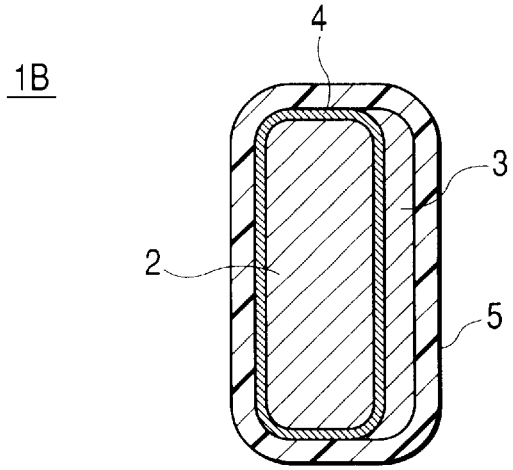
FIG. 4 shows a section of a compact antenna, which is a second preferred embodiment of the invention.

A second example of compact antenna embodying the present invention will be described below with reference to FIG. 4. FIG. 4 shows a section of a compact antenna, which is a second preferred embodiment of the invention.

As is evident from FIG. 4, a compact antenna 1B, which is this example, is configured of a coil 4 wound around unit cores 2, linking members 3 fixed to one side of a linked assembly consisting of the unit cores 2 and the coil 4, and a covering 5 for covering around the unit cores 2, the linking members 3 and the coil 4. The description of other aspects of the configuration is dispensed with because they are the same as their counterparts in the compact antenna 1A in the first embodiment of the invention.

The compact antenna 1B of this embodiment has similar advantages to those of the compact antenna 1A, which is the first preferred embodiment of the invention.

The compact antenna 1B, which is the second preferred embodiment of the present invention, can be manufactured by a third method comprising a step of winding a coil, a step of inserting a plurality of unit cores into a hollow in the coil, and a step of linking the plurality of unit cores inserted into the hollow in the coil by the linking members.

By this third manufacturing method, as the plurality of the unit cores 2 inserted into the coil 4 are linked by the linking members 3 after the unit cores 2 are inserted into the coil 4, the insertion of the unit cores 2 into the coil 4 is made easier than inserting the unit cores 2 and the linking members 3 into the hollow in the wound coil 4, resulting in corresponding saving in the manufacturing cost of the compact antenna.

As any compact antenna according to the present invention has a configuration in which the external faces of the plurality of unit cores are liked by linking members and the linking members are arranged to be bendable between the unit cores, the linking members are bent when subjected to external force and the external force working on the unit cores is thereby eased. Accordingly, the unit cores are protected from destruction, and stable communication performance is ensured for a long period. Also, as the unit cores are linked by the linking members, even if any external force deforms the compact antenna, the set spacing between the unit cores will remain unchanged to enable stable communication performance to be maintained. Moreover, as the unit cores are linked by the linking members, the deformation of the coil is regulated by the linked assembly of the unit cores, and deterioration in communication performance due to coil deformation can also be prevented.

On the other hand, a compact antenna manufacturing method according to the invention, as the plurality of unit cores linked by the linking members are inserted into the hollow in the coil, makes it possible to insert a plurality of unit cores into a coil in a single process, and the time required for inserting unit cores into the coil can be made shorter than inserting a plurality of unit cores one by one into a coil, resulting in corresponding saving in the compact antenna manufacturing cost. Furthermore, another compact antenna manufacturing method according to the invention, as the coil is wound around the linked assembly of the linking members and the plurality of unit cores linked to them after linking the plurality of unit cores by the linking members, makes the integration of the coil with the linked assembly easier than inserting the unit cores and the linking members into the hollow in the wound coil, resulting in corresponding saving in the compact antenna manufacturing cost.

What is claimed is:

1. A compact antenna comprising a plurality of unit cores, linking members for linking external faces of the unit cores, and a coil wound around the plurality of unit cores, wherein the linking members are bendably arranged between the unit cores.

2. The compact antenna according to claim 1, wherein the linking members are formed of elastic bodies.

3. A compact antenna manufacturing method comprising a step of winding a coil, a step of linking a plurality of unit cores by linking members, and a step of inserting into a hollow in the coil the plurality of unit cores linked by the linking members.

4. A compact antenna manufacturing method comprising a step of linking a plurality of unit cores by linking members and a step of winding a coil around a linked assembly consisting of the linking members and the plurality of unit cores linked to them.

* * * * *

UNITED STATES PATENT AND TRADEMARK OFFICE

CERTIFICATE OF CORRECTION

PATENT NO. : 6,603,441 B2
DATED : August 5, 2003
INVENTOR(S) : Kentaro Teshima

It is certified that error appears in the above-identified patent and that said Letters Patent is hereby corrected as shown below:

Column 6,
Line 27, delete “them.” and substitute -- the linking members. -- in its place.

Signed and Sealed this

Twenty-third Day of December, 2003

JAMES E. ROGAN
*Director of the United States Patent and Trademark Office*